US005837382A

United States Patent [19]

Hayashi et al.

[11] Patent Number: 5,837,382

[45] Date of Patent: Nov. 17, 1998

[54] THERMAL TRANSFER SHEET

[75] Inventors: Masafumi Hayashi; Fumihiko Mizukami; Yuji Sano, all of Tokyo-To, Japan

[73] Assignee: Dai Nippon Printing Co., Ltd., Japan

[21] Appl. No.: 649,813

[22] Filed: May 17, 1996

[30] Foreign Application Priority Data

May 19, 1995 [JP] Japan ..... 7-145353

[51] Int. Cl.[6] ..... B41M 5/26

[52] U.S. Cl. ..... 428/484; 428/195; 428/488.1; 428/516; 428/913; 428/914

[58] Field of Search ..... 428/195, 484, 428/488.1, 488.4, 913, 914

[56] References Cited

U.S. PATENT DOCUMENTS

| | | | |
|---|---|---|---|
| 4,828,922 | 5/1989 | Hayashi et al. | 428/195 |
| 4,853,274 | 8/1989 | Makishima et al. | 428/143 |

FOREIGN PATENT DOCUMENTS

| | | | |
|---|---|---|---|
| 62-267191 | 11/1987 | Japan | 428/484 |
| 2-108592 | 4/1990 | Japan | 428/484 |

*Primary Examiner*—Bruce H. Hess
*Attorney, Agent, or Firm*—Parkhurst & Wendel, L.L.P

[57] ABSTRACT

A thermal transfer sheet including: a substrate and a hot-melt ink layer provided on one side of the substrate. The hot-melt ink layer including a colorant, a binder resin, a dispersing agent containing a phytosterol component, and a wax.

3 Claims, 1 Drawing Sheet

THERMAL TRANSFER SHEET

BACKGROUND OF THE INVENTION

1. Field of the Invention

The present invention relates to a thermal transfer sheet, and more particularly to a thermal transfer sheet which has a hot-melt ink layer containing a particular dispersing agent and can provide a print having good quality.

2. Background Art

In recent years, thermal transfer sheets utilizing a hot-melt transfer system have become used for output printing for computers, word processors and the like. In general, for the thermal transfer sheets utilizing a thermal transfer system, a 3 to 20 $\mu$m-thick polyethylene terephthalate film is provided as a substrate, and a hot-melt ink is coated on the substrate to form a hot-melt ink layer.

The hot-melt ink used in the conventional thermal transfer sheets comprises a dispersion of a colorant in a binder resin or a wax. The use of a hot-melt ink excellent in dispersibility of a colorant is necessary for the preparation of a thermal transfer sheet which can provide a print having high density and good quality. Further, the hot-melt ink layer should be transferred by heat from a thermal head through the backside of the substrate onto an object without causing the so-called "dropouts" or "missing." Further, there is an ever-increasing demand for a reduction in price of the thermal transfer sheet.

In general, homogeneous dispersion of carbon black in a hot-melt ink is necessary for realizing a good black print. Since, however, carbon black has high cohesive force, it is difficult to prepare a homogeneous dispersion system by mere heat-mixing of carbon black with other material, for example, wax or a binder resin. For this reason, coating of carbon black with a binder resin optionally in combination with the use of an ester wax for improving the dispersibility and compatibility has been used to prepare an inexpensive hot-melt ink. In this method, carbon black is previously heat-mixed with the binder resin, and the mixture is then chipped. Therefore, an ethylene/vinyl acetate copolymer (EVA) having a relatively low melting point and high fluidity has been used as the binder resin for coating the colorant, and the other resins have been unusable as the binder resin from the viewpoint of dispersibility and compatibility with the wax. Further, as described above, when the dispersibility of the colorant, after coating with EVA, is still unsatisfactory, an ester wax, particularly carnauba wax, has been used as a dispersing agent and, together with EVA, heat-mixed with the colorant, followed by chipping of the mixture. The above binder resin and ester wax, however, are expensive, and, due to the high cost in combination with the limitation of usable binder resin, there is a limit to the preparation of a hot-melt ink which is inexpensive and has an added value. Further, in many cases, the hot-melt ink after transfer is required to have scratch resistance, and the hot-melt ink using EVA as the binder has poor scratch resistance and, hence, is unsatisfactory also in this respect.

The present invention has been made under the above circumstances, and an object of the present invention is to provide at a low production cost a thermal transfer sheet which has a hot-melt ink layer with components being satisfactorily dispersed therein and can provide a print having good quality.

SUMMARY OF THE INVENTION

According to the present invention, the above object can be attained by a thermal transfer sheet comprising: a substrate; and a hot-melt ink layer provided on one side of the substrate, the hot-melt ink layer comprising a colorant, a binder resin, a dispersing agent containing a phytosterol component, and a wax.

According to the thermal transfer sheet of the present invention, the use of the dispersing agent containing a phytosterol component in the hot-melt ink layer results in improved compatibility of a colorant with a binder resin or a wax. By virtue of this, the dispersion of individual components in the hot-melt ink layer becomes very good, resulting in the provision of a high-density print and, at the same time, making it possible to use resins which have been unusable in the prior art due to low capability of dispersing a colorant.

DETAILED DESCRIPTION OF THE INVENTION

Preferred embodiments of the present invention will be described in detail with reference to the accompanying drawings.

Figure 1:
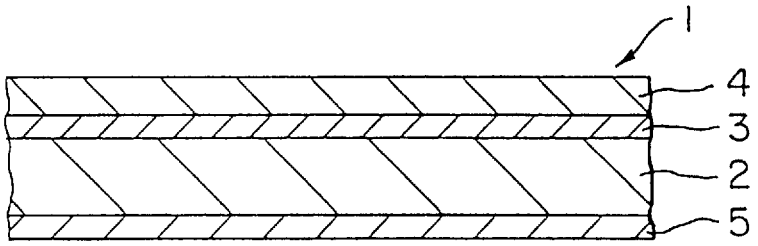
FIG. 1 is a cross-sectional view showing one embodiment of the thermal transfer sheet according to the present invention.

FIG. 1 is a cross-sectional view of one embodiment of the thermal transfer sheet according to the present invention. In FIG. 1, the thermal transfer sheet 1 of the present invention comprises a substrate 2, a hot-melt ink layer 4 laminated on one side of the substrate 2 through a release layer 3, and a backside layer 5 provided on the other side of the substrate 2.

Figure 2:
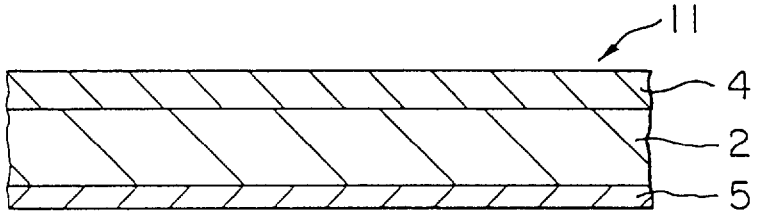
FIG. 2 is a cross-sectional view showing another embodiment of the thermal transfer sheet according to the present invention.

FIG. 2 is a cross-sectional view of another embodiment of the thermal transfer sheet according to the present invention. In FIG. 2, the thermal transfer sheet 11 of the present invention comprises a substrate 2, a hot-melt ink layer 4 laminated on one side of the substrate 2, and a backside layer 5 provided on the other side of the substrate 2.

Figure 3:
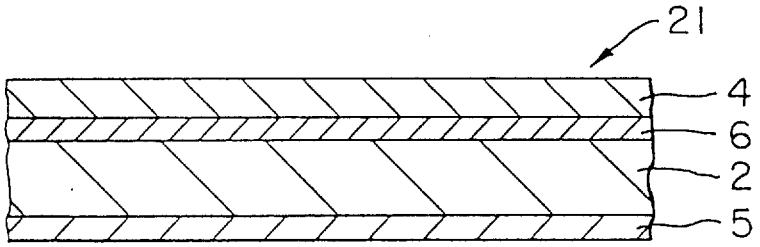
FIG. 3 is a cross-sectional view showing a further embodiment of the thermal transfer sheet according to the present invention.

FIG. 3 is a cross-sectional view of a further embodiment of the thermal transfer sheet according to the present invention. In FIG. 3, the thermal transfer sheet 21 of the present invention comprises a substrate 2, a hot-melt ink layer 4 provided on one side of the substrate 2 through a matte layer 6, and a backside layer 5 provided on the other side of the substrate 2.

Figure 4:
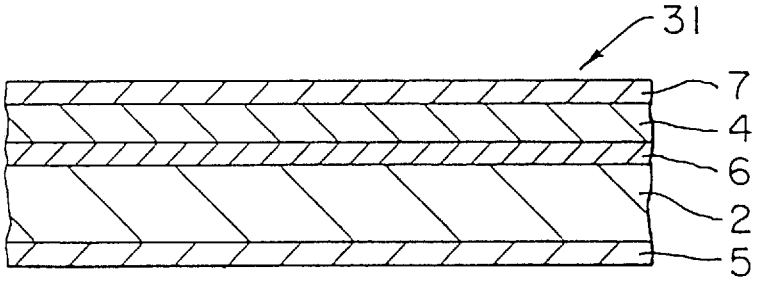
FIG. 4 is a cross-sectional view showing a still further embodiment of the thermal transfer sheet according to the present invention.

FIG. 4 is a cross-sectional view of a still further embodiment of the thermal transfer sheet according to the present invention. In FIG. 4, the thermal transfer sheet 31 of the present invention comprises a substrate 2, a hot-melt ink layer 4 and a surface layer 7 provided in that order on one side of the substrate 2 through a matte layer 6, and a backside layer 5 provided on the other side of the substrate 2.

The substrate 2 is not particularly limited, and any material used in the conventional thermal transfer sheet is usable as the substrate. Specific examples of substrates usable herein include plastic films of polyesters, polypropylene, cellophane, polycarbonates, cellulose acetate, polyethylene, polyvinyl chloride, polystyrene, nylon, polyimides, polyvinylidene chloride, polyvinyl alcohol, fluororesins, chlorinated rubber, and ionomers; papers, such as glassine paper, condenser paper, and paraffin paper; and nonwoven fabrics. Further, any composite of the above materials may also be used as the substrate.

The thickness of the substrate may be properly determined so that required strength and thermal conductivity can be obtained, for example, may be about 1 to 100 μm.

The release layer 3 functions to facilitate the transfer of the hot-melt ink layer in its area heated by means of a thermal head onto an object at the time of thermal transfer. The release layer 3 is formed of a release agent, such as a wax, a silicone wax, a silicone resin, a fluororesin, or an acrylic resin. It may be formed by adding necessary additives to the above resin, dissolving or dispersing the mixture in a suitable resin to prepare an ink, coating the ink onto the substrate 2 by conventional means, and drying the coating. The thickness of the release layer 3 is preferably about 0.1 to 5 μm.

The colorant incorporated into the hot-melt ink layer 4 may be carbon black or a color pigment, such as yellow, magenta, or cyan. The content of the colorant may be about 1 to 80% by weight, preferably about 5 to 25% by weight.

Binder resins usable for constituting the hot-melt ink layer include thermoplastic resins having a relatively low melting point, such as linear low-density polyethylene, low density polyethylene, medium density polyethylene, high density polyethylene, polypropylene resin, ethylene/vinyl acetate copolymer, polyester resin, polyamide resin, ionomer resin, ethylene/acrylate resin, styrene/butadiene copolymer, acrylonitrile/butadiene copolymer, and polystyrene resin. Among them, linear low density polyethylene is particularly preferred because it is inexpensive. The melt index (MI) of the above binder resin is preferably in the range of from 30 to 200.

In the present invention, the binder resin content of the hot-melt ink may be 1 to 70% by weight, preferably 2 to 20% by weight.

The dispersing agent incorporated into the hot-melt ink layer is characterized by comprising a phytosterol and/or a modified phytosterol as a phytosterol component. The term "modified phytosterol" used herein refers mainly to an esterification product of the —OH group of the phytosterol with the —COOH group of a higher fatty acid and a hydrogenation product of the phytosterol. The phytosterol component is a sterol extracted from vegetable fats and oils, for example, sugar cane, wheat germ, rice bran, soybean, rapeseed, coconut oil, or cacao butter, and is an unsaturated compound mainly having a β-hydroxyl group in the carbon atom at the 3-position, a $C_4$–$C_{10}$ hydrocarbon region in the carbon atom at the 17-position, and a double bond between the 5-position and the 6-position or at other position(s). It generally comprises β-sitosterol ($C_{29}H_{50}O$), stigmasterol ($C_{29}H_{48}O$), and campesterol ($C_{28}H_{48}O$). The β-sitosterol is a main component of the sitosterol compound, and the sitosterol compound is constituted by, in addition to the β-sitosterol, α-sitosterol, γ-sitosterol, dihydrositosterol and the like. The material containing the phytosterol exists also in a free form or as an ester or a glucoside, depending upon the form of the vegetable fats and oils. The present inventors have found that the use of a dispersing agent containing the above phytosterol component contributes to a marked improvement in compatibility of the binder resin with the wax, or dispersibility or compatibility between the colorant and the binder resin, between the colorant and the wax, or among these three components.

Natural waxes containing phytosterol, for example, sugar cane wax (SCW) and rice wax, may be used as the phytosterol.

In the present invention, the content of the dispersing agent in the hot-melt ink layer may be 0.1 to 50% by weight, preferably about 1 to 30% by weight. The content of the phytosterol component in the dispersing agent is about 1 to 100% by weight. The remainder of the dispersing agent may be constituted by a higher fatty acid, a higher alcohol, an esterification product thereof, and a wax. The content of the phytosterol component in the hot-melt ink layer is preferably 0.1 to 20% by weight. When the content of the dispersing agent is less than 0.1% by weight, the dispersibility or compatibility between the binder resin and the wax or between the binder resin and the colorant is unsatisfactory, making it impossible to provide contemplated print density or transferability of the ink layer. On the other hand, when the content of the dispersing agent exceeds 50% by weight, the phytosterol component is excessively present, resulting in deteriorated resistance of the hot-melt ink and, consequently, remarkably deteriorated scratch resistance of the print. Preferably, the dispersing agent containing a phytosterol component used in the present invention has a melting point equal to waxes commonly used in the thermal transfer. For example, the melting point may be 50° to 160° C. (DSC method; temperature rise rate 7.5° C./min), preferably 50° to 80° C.

The wax constituting the hot-melt ink layer is used for improving the transferability of the ink layer at the time of printing. Waxes usable herein include microcrystalline wax, carnauba wax, paraffin wax, Fischer-Tropsh wax, various low-molecular weight polyethylene, Japan wax, beeswax, spermaceti, insect wax, wool wax, shellac wax, candelilla wax, petrolatum, polyester wax, partially modified wax, fatty acid esters, and fatty acid amides. In the present invention, the content of the wax in the hot-melt ink layer may be suitably determined according to the required viscosity of the hot-melt ink. For example, it may be about 1 to 90% by weight, preferably about 20 to 80% by weight.

The hot-melt ink layer according to the present invention may further comprise, in addition to the above colorant, binder resin, dispersing agent, and wax, various additives according to need.

The hot-melt ink layer may be formed on the substrate by hot-melt coating wherein a hot-melt ink is coated in a melt form. Further methods usable herein include hot lacquer coating, gravure coating, gravure reverse coating, roll coating, emulsion coating and other conventional methods. The thickness of the hot-melt ink layer is preferably about 0.5 to 20 μm.

The backside layer 5 is provided in order to improve the slip property of a thermal head and to prevent sticking. It is formed of a binder resin and other necessary additives. Binder resins usable herein include, for example, cellulosic resins, such as ethyl cellulose, hydroxyethyl cellulose, hydroxypropyl cellulose, methyl cellulose, cellulose acetate butyrate, and nitrocellulose, vinyl resins, such as polyvinyl alcohol, polyvinyl acetate, polyvinyl butyral, polyvinyl acetal, polyvinyl pyrrolidone, acrylic resin, polyacrylamide, and acrylonitrile/styrene copolymer, polyester resin, polyurethane resin, silicone-modified or fluorine-modified urethane resin. Preferably, a resin having some reactive group, for example, a hydroxyl group, among the above resins is used in combination with a polyisocyanate or the like as a crosslinking agent to form a crosslinked resin layer. Other additives, such as an antistatic agent, may be optionally added to the backside layer 5.

The matte layer 6 functions to impart a matte effect to a print, formed by thermal transfer by means of a thermal head, and to impart an antistatic effect to the thermal transfer sheet. The matte layer 6 is generally formed of a dispersion of a colorant and an inorganic filler in a polyester resin, an acrylic resin or the like, and the thickness thereof may be about 0.1 to 5 $\mu$m. The matte layer 6 may be formed by conventional coating means, such as gravure direct coating or gravure reverse coating.

The surface layer 7 functions to enable good transfer onto an object having a relatively rough surface and to prevent the occurrence of blocking of the thermal transfer sheet in a rolled state. The surface layer 7 may be the same as that provided in the conventional thermal transfer sheet. For example, it may be an about 0.1 to 3 $\mu$m-thick coating of a wax. Alternatively, it may be formed of an adhesive resin and a releasable resin. In this case, a thermoplastic resin having a relatively low melting point may be used as the adhesive resin, and specific examples thereof include ethylene/vinyl acetate copolymer, ethylene/acrylate copolymer, polybutene, petroleum resin, vinyl chloride/vinyl acetate copolymer, and polyvinyl acetate. Preferably, the adhesive resin has a higher melt viscosity than the binder resin used in the formation of the hot-melt ink layer 4. The releasable resin may be a silicone resin. Silicone resins usable herein include silicone modified-acrylic resin, silicone-modified urethane resin, silicone-modified epoxy resin, and silicone-modified urea resin.

The ratio on a solid basis of the adhesive resin to the releasable resin in the surface layer 7 is preferably 10:0.1 to 10:20. The surface layer 7 may further comprise other optional additives such as an antistatic agent. The thickness of the surface layer 7 is preferably about 0.1 to 5 $\mu$m.

The following examples illustrate the present invention but are not intended to limit it. In the examples, all "parts" or "%" are by weight.

(EXAMPLES 1 TO 22 AND COMPARATIVE EXAMPLES 1 TO 9)

Preparation of hot-melt inks

Inks (inks 1 to 22) respectively having the following compositions were prepared as hot-melt inks of the present invention.

| | |
|---|---|
| Ink 1 | |
| Carbon black (average particle diameter 75 nm) | 15% |
| Linear low density polyethylene (MI = 50) | 20% |
| Sugar cane wax (phytosterol component content = 2%) | 10% |
| Paraffin wax (m.p. = 69° C.) | 55% |
| Ink 2 | |
| Carbon black (average particle diameter 75 nm) | 10% |
| Linear low density polyethylene (MI = 35) | 6% |
| Sugar cane wax (phytosterol component content = 14%) | 4% |
| Paraffin wax (m.p. = 69° C.) | 80% |

-continued

| | |
|---|---|
| Ink 3 | |
| Carbon black (average particle diameter 75 nm) | 10% |
| Linear low density polyethylene (MI = 50) | 10% |
| Sugar cane wax (phytosterol component content = 7%) | 5% |
| Paraffin wax (m.p. = 69° C.) | 75% |
| Ink 4 | |
| Carbon black (average particle diameter 35 nm) | 15% |
| Linear low density polyethylene (MI = 150) | 5% |
| Rice wax (phytosterol component content = 0.2%) | 15% |
| Paraffin wax (m.p. = 69° C.) | 65% |
| Ink 5 | |
| Carbon black (average particle diameter 35 nm) | 15% |
| Ethylene/vinyl acetate copolymer (MI = 400) | 5% |
| Sugar cane wax (phytosterol component content = 2%) | 15% |
| Paraffin wax (m.p. = 69° C.) | 65% |
| Ink 6 | |
| Carbon black (average particle diameter 75 nm) | 10% |
| Polyester resin (glass transition temp. = 20° C.) | 5% |
| Sugar cane wax (phytosterol component content = 14%) | 5% |
| Paraffin wax (m.p. = 69° C.) | 80% |
| Ink 7 | |
| Carbon black (average particle diameter 75 nm) | 10% |
| Linear low density polyethylene (MI = 35) | 10% |
| Sugar cane wax (phytosterol component content = 7%) | 20% |
| Paraffin wax (m.p. = 69° C.) | 60% |
| Ink 8 | |
| Carbon black (average particle diameter 75 nm) | 10% |
| Linear low density polyethylene (MI = 35) | 10% |
| Sugar cane wax (phytosterol component content = 7%) | 6% |
| Paraffin wax (m.p. = 69° C.) | 74% |
| Ink 9 | |
| Carbon black (average particle diameter 75 nm) | 10% |
| Linear low density polyethylene (MI = 35) | 4% |
| Sugar cane wax (phytosterol component content = 7%) | 6% |
| Paraffin wax (m.p. = 69° C.) | 80% |
| Ink 10 | |
| Carbon black (average particle diameter 75 nm) | 10% |
| Linear low density polyethylene (MI = 50) | 10% |
| Sterol-containing wax 1 (phytosterol component content = 20%) | 20% |
| Paraffin wax (m.p. = 69° C.) | 60% |
| Ink 11 | |
| Carbon black (average particle diameter 75 nm) | 12% |
| Linear low density polyethylene (MI = 110) | 8% |
| Sterol-containing wax 1 | 20% |

-continued

| | |
|---|---|
| (phytosterol component content = 20%) | |
| Paraffin wax (m.p. = 69° C.) | 60% |

Ink 12

| | |
|---|---|
| Carbon black (average particle diameter 75 nm) | 12% |
| Linear low density polyethylene (MI = 110) | 8% |
| Sterol-containing wax 1 (phytosterol component content = 20%) | 6% |
| Paraffin wax (m.p. = 69° C.) | 74% |

Ink 13

| | |
|---|---|
| Carbon black (average particle diameter 75 nm) | 12% |
| Linear low density polyethylene (MI = 110) | 8% |
| Sterol-containing wax 2 (phytosterol component content = 14%) | 6% |
| Paraffin wax (m.p. = 69° C.) | 74% |

Ink 14

| | |
|---|---|
| Carbon black (average particle diameter 75 nm) | 12% |
| Linear low density polyethylene (MI = 150) | 8% |
| Sterol-containing wax 3 (phytosterol component content = 80%) | 6% |
| Paraffin wax (m.p. = 69° C.) | 74% |

Ink 15

| | |
|---|---|
| Carbon black (average particle diameter 75 nm) | 12% |
| Linear low density polyethylene (MI = 150) | 8% |
| Sterol-containing wax 2 (phytosterol component content = 14%) | 20% |
| Paraffin wax (m.p. = 69° C.) | 60% |

Ink 16

| | |
|---|---|
| Carbon black (average particle diameter 75 nm) | 12% |
| Linear low density polyethylene (MI = 150) | 8% |
| Sterol-containing wax 3 (phytosterol component content = 80%) | 20% |
| Paraffin wax (m.p. = 69° C.) | 60% |

Ink 17

| | |
|---|---|
| Carbon black (average particle diameter 75 nm) | 12% |
| Linear low density polyethylene (MI = 110) | 8% |
| Sterol-containing wax 3 (phytosterol component content = 80%) | 3% |
| Paraffin wax (m.p. = 69° C.) | 77% |

Ink 18

| | |
|---|---|
| Carbon black (average particle diameter 75 nm) | 12% |
| Linear low density polyethylene (MI = 110) | 8% |
| Sterol-containing wax 3 (phytosterol component content = 80%) | 0.1% |
| Paraffin wax (m.p. = 69° C.) | 79.9% |

Ink 19

| | |
|---|---|
| Carbon black (average particle diameter 75 nm) | 12% |
| Linear low density polyethylene (MI = 110) | 2% |
| Sterol-containing wax 1 (phytosterol component content = 7%) | 20% |
| Paraffin wax (m.p. = 69° C.) | 66% |

Ink 20

| | |
|---|---|
| Carbon black (average particle diameter 75 nm) | 12% |
| Linear low density polyethylene (MI = 110) | 1% |
| Sterol-containing wax 1 (phytosterol component content = 7%) | 20% |
| Paraffin wax (m.p. = 69° C.) | 67% |

Ink 21

| | |
|---|---|
| Carbon black (average particle diameter 75 nm) | 12% |
| Linear low density polyethylene (MI = 220) | 8% |
| Sterol-containing wax 1 (phytosterol component content = 7%) | 20% |
| Paraffin wax (m.p. = 69° C.) | 60% |

Ink 22

| | |
|---|---|
| Carbon black (average particle diameter 75 nm) | 12% |
| Linear low density polyethylene (MI = 20) | 10% |
| Sterol-containing wax 1 (phytosterol component content = 7%) | 20% |
| Paraffin wax (m.p. = 69° C.) | 58% |

Further, for comparison, hot-melt inks (inks C1 to C9) respectively having the following compositions were prepared.

Ink C1

| | |
|---|---|
| Carbon black (average particle diameter 75 nm) | 15% |
| Linear low density polyethylene (MI = 50) | 20% |
| Carnauba wax | 10% |
| Paraffin wax (m.p. = 69° C.) | 55% |

Ink C2

| | |
|---|---|
| Carbon black (average particle diameter 75 nm) | 15% |
| Linear low density polyethylene (MI = 50) | 20% |
| Paraffin wax (m.p. = 69° C.) | 65% |

Ink C3

| | |
|---|---|
| Carbon black (average particle diameter 75 nm) | 15% |
| Ethylene/vinyl acetate copolymer (MI = 400) | 10% |
| Carnauba wax | 10% |
| Paraffin wax (m.p. = 69° C.) | 65% |

Ink C4

| | |
|---|---|
| Carbon black (average particle diameter 75 nm) | 10% |
| Polyester resin (glass transition temp. = 20° C.) | 5% |
| Carnauba wax | 10% |
| Paraffin wax (m.p. = 69° C.) | 75% |

Ink C5

| | |
|---|---|
| Carbon black (average particle diameter 75 nm) | 10% |
| Linear low density polyethylene (MI = 35) | 10% |
| Paraffin wax (m.p. = 69° C.) | 80% |

Ink C6

| | |
|---|---|
| Carbon black (average particle diameter 75 nm) | 12% |
| Linear low density polyethylene (MI = 110) | 8% |

-continued

| | |
|---|---|
| Paraffin wax (m.p. = 69° C.) | 80% |
| Ink C7 | |
| Carbon black (average particle diameter 75 nm) | 10% |
| Linear low density polyethylene (MI = 150) | 10% |
| Carnauba wax | 20% |
| Paraffin wax (m.p. = 69° C.) | 60% |
| Ink C8 | |
| Carbon black (average particle diameter 75 nm) | 10% |
| Linear low density polyethylene (MI = 50) | 10% |
| Carnauba wax | 20% |
| Paraffin wax (m.p. = 69° C.) | 60% |
| Ink C9 | |
| Carbon black (average particle diameter 75 nm) | 12% |
| Linear low density polyethylene (MI = 110) | 8% |
| Carnauba wax | 20% |
| Paraffin wax (m.p. = 69° C.) | 60% |

Thereafter, for the hot-melt inks (inks 1 to 22 and inks C1 to C9), the dispersibility of carbon black, the fluidity of the ink, and the stability of the ink were evaluated by the following methods. The results are summarized in the following Table 1.

Dispersibility

The ink was melted in an oven at 150° C., and the melt was coated on a 25 μm-thick PET film by means of a bar coater at a coverage of 5 g/m$^2$, and the dispersibility of carbon black was evaluated by visual inspection under an optical microscope.

Evaluation criteria:

◎: Satisfactorily dispersed

○: Somewhat aggregated, but posing no problem

Δ: Aggregated

X: Not dispersed

Fluidity

The relationship between the number of revolutions and the viscosity was experimentally determined with a rotating viscometer (Viscometers, manufactured by HAAKE) at 130° C.

Evaluation criteria:

◎: Good fluidity for use as a hot-melt ink

○: Acceptable fluidity for use as a hot-melt ink

Δ: Unsuitable fluidity for use as a hot-melt ink

X: Poor fluidity rendering the ink impossible for use as a hot-melt ink

Stability of ink

The ink was allowed to stand in a melted state in an oven at 140° C. The supernatant was sampled every day. The sample was coated on a 25 μm-thick PET film by means of a bar coater at a coverage of 5 g/m$^2$. Under an optical microscope, the dispersibility of carbon black was evaluated by visual inspection, and the transmittance density was evaluated by visual inspection.

Evaluation criteria:

◎: Stable for 3 to 6 days

○: Stable for 3 days

Δ: Stable for 2 days

X: Stable for less than 2 days

Preparation of thermal transfer sheet

A 6.0 μm-thick polyethylene terephthalate film (Lumirror, manufactured by Toray Industries, Inc.) was provided as a substrate, and an ink, for a matte layer, having the following composition was coated on the substrate by gravure direct coating at a coverage of 0.3 g/m$^2$ to form a matte layer. Each of the hot-melt inks (inks 1 to 22 and inks C1 to C9) as prepared above was then coated on the matte layer by hot-melt coating at a coverage of 5.0 g/m$^2$ to form a hot-melt ink layer.

An ink, for a surface layer, having the following composition was then coated on the hot-melt ink layer by gravure direct coating at a coverage of 0.3 g/m$^2$ to form a surface layer.

Then, an ink, for a backside layer, having the following composition was coated on the backside of the substrate remote from the surface layer by gravure direct coating at a coverage of 0.2 g/m$^2$ to form a backside layer. Thus, thermal transfer sheets (Examples 1 to 22 and Comparative Examples 1 to 9) were prepared.

| | |
|---|---|
| Composition of ink for matte layer | |
| Carbon black (average particle diameter 35 nm) | 20 parts |
| Polyester resin (glass transition temp. = 60° C.) | 20 parts |
| Methyl ethyl ketone/toluene (1/1) | 160 parts |
| Composition of ink for surface layer | |
| Carnauba wax emulsion | 10 parts |
| Isopropyl alcohol/water (3/1) | 90 parts |
| Composition of ink for backside layer | |
| Silicone-modified urethane resin | 10 parts |
| Polyisocyanate | 5 parts |
| Methyl ethyl ketone/toluene(1/1) | 85 parts |

Printing was carried out using the thermal transfer sheets thus prepared (Examples 1 to 22 and Comparative Examples 1 to 9) under the following printing conditions, and the prints were evaluated for the quality and the scratch resistance. The results are summarized in the following Table 1.

Printing conditions

Printing device: Experimental model

Printing energy: 0.4 mJ/dot (300 dpi thermal head for thick sheet)

Printing pressure: 4 kg

Printing speed: 10 mm/sec

Object: PPC paper (Bekk smoothness=30 sec)

Evaluation of print quality

Printing of solid and a hairline pattern was continuously performed on five sheets to evaluate the solid transferability, fill-in trouble in hairlines, and reproduction.

Evaluation criteria (Solid area)—(Hairline area)

◎: No problem—Good and no fill-in trouble

○: Some dropouts, but—Some fill-in and missing posing no problem

Δ: Significant dropouts—Significant fill-in and missing

X: Serious dropouts—Serious fill-in or not transferred

Evaluation of scratch resistance

An exclusive machine for evaluation was provided. A load of 200 g was applied to an iron ball having a diameter of 1 cm, and, in this state, the iron ball was reciprocated 20 times on the print to evaluate the scratch resistance of the print.

Evaluation criteria:

◎: No problem

○: Somewhat smeared around the print

Δ: Smeared

X: Remarkably smeared

TABLE 1

| Example No. (Ink No.) | Dispersibility of ink | Fluidity of ink | Stability of ink | Print quality: Solid area | Print quality: Hair-line area | Print quality: Scratch resistance |
|---|---|---|---|---|---|---|
| Example 1 (Ink 1) | ○ | ○ | ○ | ○ | ○ | ○ |
| Example 2 (Ink 2) | ○ | ◎ | ◎ | ○ | ○ | ○ |
| Example 3 (Ink 3) | ◎ | ◎ | ◎ | ○ | ○ | ○ |
| Example 4 (Ink 4) | ○ | ○ | ○ | ○ | ○ | ○ |
| Example 5 (Ink 5) | ○ | ○ | ○ | ○ | ○ | Δ |
| Example 6 (Ink 6) | ○ | ○ | ○ | ○ | ○ | ◎ |
| Example 7 (Ink 7) | ◎ | ○ | ◎ | ◎ | ○ | ◎ |
| Example 8 (Ink 8) | ○ | ○ | ○ | ◎ | ○ | ○ |
| Example 9 (Ink 9) | ○ | ○ | ○ | ○ | ○ | ○ |
| Example 10 (Ink 10) | ◎ | ○ | ◎ | ◎ | ○ | ○ |
| Example 11 (Ink 11) | ◎ | ◎ | ◎ | ○ | ◎ | ○ |
| Example 12 (Ink 12) | ◎ | ◎ | ○ | ○ | ◎ | ○ |
| Example 13 (Ink 13) | ◎ | ◎ | ◎ | ○ | ◎ | ○ |
| Example 14 (Ink 14) | ◎ | ◎ | ◎ | ○ | ◎ | ○ |
| Example 15 (Ink 15) | ◎ | ◎ | ◎ | ○ | ◎ | ○ |
| Example 16 (Ink 16) | ◎ | ◎ | ◎ | ○ | ◎ | ○ |
| Example 17 (Ink 17) | ◎ | ◎ | ○ | ○ | ◎ | ○ |
| Example 18 (Ink 18) | ◎ | ◎ | Δ | ○ | ○ | ○ |
| Example 19 (Ink 19) | ○ | ○ | ○ | Δ | ○ | Δ |
| Example 20 (Ink 20) | ○ | ○ | ○ | Δ | ○ | Δ |
| Example 21 (Ink 21) | ○ | ○ | ○ | ○ | ○ | Δ |
| Example 22 (Ink 22) | ○ | ○ | ○ | ○ | X | ○ |
| Comparative Example 1 (Ink C1) | ○ | Δ | X | ○ | Δ | ○ |
| Comparative Example 2 (Ink C2) | X | X | X | — | — | — |
| Comparative Example 3 (Ink C3) | ○ | ○ | ○ | ○ | ○ | Δ |
| Comparative Example 4 (Ink C4) | X | X | X | — | — | — |
| Comparative Example 5 (Ink C5) | X | X | X | Δ | X | Δ |
| Comparative Example 6 (Ink C6) | X | X | X | X | ○ | Δ |
| Comparative Example 7 (Ink C7) | Δ | Δ | X | Δ | ○ | ○ |
| Comparative Example 8 (Ink C8) | Δ | Δ | X | Δ | ○ | ○ |
| Comparative Example 9 (Ink C9) | ○ | Δ | X | Δ | ○ | Δ |

As is apparent from Table 1, the hot-melt inks (inks 1 to 22) comprising a dispersing agent containing a phytosterol component according to the present invention have good dispersibility, fluidity and stability and can form a thermal transfer sheet having an even hot-melt ink layer.

All the thermal transfer sheets (Examples 1 to 22) according to the present invention could provide prints having good quality. For the scratch resistance of the print, as compared with the thermal transfer sheet of Example 5 (binder resin: ethylene/vinyl acetate copolymer), the thermal transfer sheets of the other examples (binder resin: polyethylene resin or polyester resin) provided prints having better scratch resistance. The use of a polyethylene resin or a polyester resin as a binder resin in the prior art could not have provided a hot-melt ink excellent in both dispersibility and ink fluidity. This is clearly substantiated by inks C1, C2, and C4 to C9. By contrast, according to the present invention, the use of a dispersing agent containing a phytosterol component has made it possible to use a polyethylene resin or a polyester resin, having excellent scratch resistance, which has been unusable in the prior art. Further, as is apparent from a comparison of Example 5 with Comparative Example 3, according to the present invention, the amount of a relatively expensive ethylene/vinyl acetate copolymer used can be reduced, and, at the same time, a relatively inexpensive polyethylene resin or polyester resin can be used as the binder resin, rendering the present invention advantageous also in production cost.

Further, hot-melt inks containing not less than 0.1% by weight of a phytosterol (inks 1 to 17 and 19 to 22) had very good stability and were stable for 3 days or longer in the ink stability test.

What is claimed is:

1. A thermal transfer sheet comprising:

a substrate; and a hot-melt ink layer provided on one side of the substrate, the hot-melt ink layer comprising a colorant, a binder resin, a dispersing agent containing a phytosterol component, and a wax, wherein said binder resin comprises a linear low density polyethylene having a melt index (MI) of 30 to 200 and said phytosterol component consists of at least one of phytosterol and a modified phytosterol selected from an esterified phytosterol and a hydrogenated phytosterol.

2. The thermal transfer sheet according to claim 1, wherein the linear low density polyethylene is contained in an amount of 2 to 20% by weight in the hot-melt ink layer.

3. The thermal transfer sheet according to claim 1, wherein the hot-melt ink layer has a colorant content of 5 to 25% by weight and a phytosterol component content of 0.1 to 20% by weight.

* * * * *